US005643144A

United States Patent [19]

Trulaske

[11] Patent Number: 5,643,144

[45] Date of Patent: Jul. 1, 1997

[54] LUBRICATION SYSTEM FOR TREADMILL

[75] Inventor: James A. Trulaske, St. Louis, Mo.

[73] Assignee: True Fitness Technology, Inc., O'Fallong, Mo.

[21] Appl. No.: 638,844

[22] Filed: Apr. 29, 1996

[51] Int. Cl.[6] ..... A63B 22/02

[52] U.S. Cl. ..... 482/54; 198/841

[58] Field of Search ..... 482/51, 54; 198/841

[56] References Cited

U.S. PATENT DOCUMENTS

| | | |
|---|---|---|
| 2,066,206 | 12/1936 | Laurie . |
| 2,558,759 | 7/1951 | Johnson . |
| 3,356,367 | 12/1967 | Tewksbury . |
| 3,491,543 | 1/1970 | Field . |
| 3,518,985 | 7/1970 | Quinton . |
| 3,659,845 | 5/1972 | Quinton . |
| 3,703,284 | 11/1972 | Hesen . |
| 3,711,812 | 1/1973 | Cherry . |
| 3,815,960 | 6/1974 | Russ, Sr. et al. . |
| 3,972,681 | 8/1976 | Clack et al. . |
| 4,149,624 | 4/1979 | Douty et al. . |
| 4,226,325 | 10/1980 | Vandas . |
| 4,334,676 | 6/1982 | Schonenberger . |
| 4,344,616 | 8/1982 | Ogden . |
| 4,357,249 | 11/1982 | Mellor . |
| 4,394,160 | 7/1983 | Freitag . |
| 4,537,285 | 8/1985 | Brown et al. . |
| 4,602,779 | 7/1986 | Ogden . |
| 4,614,337 | 9/1986 | Schonenberger . |
| 4,635,927 | 1/1987 | Shu . |
| 4,635,928 | 1/1987 | Ogden et al. . |
| 4,643,418 | 2/1987 | Bart . |
| 4,659,074 | 4/1987 | Taitel et al. . |
| 4,664,371 | 5/1987 | Vlander . |
| 4,704,857 | 11/1987 | Stahlecker . |
| 4,749,181 | 6/1988 | Pittaway et al. . |
| 4,872,664 | 10/1989 | Parker . |
| 4,944,385 | 7/1990 | Shelby . |
| 5,100,127 | 3/1992 | Melnick et al. . |
| 5,433,679 | 7/1995 | Szymczak et al. . |

OTHER PUBLICATIONS

Drawing of Fig. 1 DN 3243 WBC May 9, 1986.

*Primary Examiner*—Lynne A. Reichard
*Attorney, Agent, or Firm*—Paul M. Denk

[57] ABSTRACT

A treadmill having continuous solid lubrication system between the inner surface of the endless belt and the support deck. The treadmill has an endless belt entrained around a drive roller and an idler roller. The belt has a first or upper reach and a second or lower reach extending between the rollers. The belt has an outer surface and an inner surface. The endless belt encircles a support deck so that a user positioned on the outer surface of the upper reach is supported by the top side of the deck. The inner surface of the upper reach is in a sliding relationship with the deck. The continuous solid lubrication system is positioned below the deck in a downwardly orientated position. The solid lubrication system includes a solid wax in an elongated solid lubricant channel. The channel is attached at an angle to the under side of the deck so that the channel and the solid wax engage the inner surface of the lower reach of the belt. The belt abrades the solid wax and the channel as it moves along its continuous path imparting lubrication to the belt. As increased tension is applied to the upper reach, more lubricant is applied to the inner surface of the belt.

8 Claims, 1 Drawing Sheet

LUBRICATION SYSTEM FOR TREADMILL

BACKGROUND OF THE INVENTION

This invention relates generally to exercise equipment and, more particularly, to a lubrication system for an endless belt treadmill.

Exercise treadmills are well known to the art. Generally, the exercise treadmill has deck covered by an endless belt. The user is positioned on the deck and his or her feet engage the endless bell The user walks forward and the belt moves in the opposite direction. In that manner, the user stays positioned on the deck and does not move forward. There are basically two types of endless belt conventional treadmills. In the first type, the endless belt is looped or entrained about idler rollers and covers the deck. As the user walks, he or she drives the endless belt about the rollers and deck. In the second type, the endless belt is entrained about and driven by a motorized drive roller, for example. The speed at which the belt moves may be variable. In any event,the user stands on the belt on the support deck facing forward and belt is driven backward, relative to the user. The user then is forced to walk forward on the belt to maintain position. Either type of treadmill may have additional features such as devices to exercise the upper torso, computers, timers and so forth.

Whether the treadmill employs a user driven belt or a motor driven belt, when the user's foot impacts the belt surface, the belt presses against the deck causing friction between the belt and deck. Such friction reduces belt life and can impede smooth operation of the endless bell. In treadmills using motor driven belts, the friction places additional stress on the drive system. This results in additional power consumption and heat generation.

Treadmill builders have attempted to minimize the effects of belt to deck friction by waxing the treadmill deck or the inner surface of the belt prior to assembly of the treadmill. For example, the manufacturer can manually rub wax on the inner belt surface. Furthermore, the manufacturer could embed solid wax particles in the belt. U.S. Pat. No. 3.659, 845, to Quinton, discloses a treadmill having an endless belt impregnated with wax.

As shown in U.S. Pat. No. 3,703,284, to Hesen, treadmill constructions are known in which a heavy, multi-ply nylon belt is driven along a metal bedplate, with the bedplate being composed of a high heat conductivity material (e.g. a metal plate) which in turn is coated with a Teflon coating so as to result in low friction between the moving belt and the bed plate. However, as admitted in the patent, the Teflon coating applied to the metal bed tended to wear from the metal plate with a consequent rise in the coefficient of friction between the belt and the plate resulting in temperature increases for the belt.

It will be appreciated, therefore, that despite the manufacturing method employed, wax or lubricant applied at the time of assembly dissipates as the treadmill is used. While an initial waxed belt to deck coefficient of friction may be 0.2, this number increases as treadmill use increases. Eventually, after about 600 hours of use, the belt to deck coefficient of friction rises to approximately 0.4. An acceptable coefficient of friction to maintain the serviceability of the belt is approximately 0.2 to 0.3.

The servicing of treadmills is a particularly important concern in heavy use applications such as health clubs. In a health club setting a single treadmill may operate nearly continuously for eight to twelve or more hours a day. The continuous operation causes a noticeable decrease in performance after 200 to 300 hours of use. If the treadmill is neglected, it can fail after 600 to 1000 hours of service.

Various mechanism for applying a lubricant to the inner surface of the endless belt have been tried. For example, U.S. Pat. No. 5,433,679 to Szymczak et al, provides a lubrication system that requires sophisticated pumps to apply the lubricant. Furthermore, a monitoring circuit is employed to monitor the application of lubricant. Such devices add expense to the construction and are prone to nozzle blockage and failure. Reference also may be made to U.S. Pat. No. 4,344,616, which may be relevant to the instant invention.

It is desirable, therefore, to have a treadmill that has minimal belt to deck friction so as to avoid wear and failure. Moreover, it is desirable to have such a treadmill that extends the length of time between servicing and thereby decreases down time. Such a treadmill should employ a relatively simple means for applying a lubricant to the inner surface of the endless belt to decrease the coefficient of friction between the belt and the deck.

SUMMARY OF THE INVENTION

It is among the several objects and features of the present invention to provide a exercise treadmill that has minimal friction between the endless belt and the support deck.

It is another object of the present to provide such a treadmill containing a system for continuous lubrication of the inner surface of the endless belt.

It is still another object of the invention to provide such a treadmill that adds additional lubrication during periods of increased load or friction.

Still another object of the invention is to provide such a treadmill wherein solid lubrication is applied to the inner surface of the belt based upon time of treadmill use, distance traveled, and increase in load or friction.

Another object of the present invention is to provide such a treadmill that minimizes the electrical load required by a motor driven endless belt.

A further object of the present invention is to provide such a treadmill in which the solid lubrication system is reliable in operation, easy to replenish or replace, simple in construction and does not require electronics, sensors or multiple moving parts, is simple and economical to build and well suited for its intended purposes.

Other objects and features of the invention will be in part apparent and in part pointed out hereinafter.

In accordance with the invention, briefly stated, a treadmill having continuous solid lubrication system on an inner surface of the endless belt and the support deck is provided. The treadmill has an endless belt entrained around a drive roller and an idler roller. The belt has a first or upper reach and a second or lower reach extending between the rollers. The belt has an outer surface and an inner surface. The endless belt encircles a support deck so that a user positioned on the outer surface of the upper reach is supported by the top side of the deck. The inner surface of the upper reach is in a sliding relationship with the deck. The continuous solid lubrication system is positioned below the deck in a downwardly orientated position. The solid lubrication system includes a solid wax in a Teflon channel. The channel is attached at an angle to the under side of the deck so that the trough and the solid lubricant engage the inner surface of the lower reach of the belt. The belt abrades the solid wax and Teflon channel as it moves along its continuous path imparting lubrication to the belt.

More specifically, in the preferred embodiment, a Teflon channel approximately ¾ inches high and 1 inch wide by 10 inches long is filled with high temperature wax. When the wax is cured it is at the same height as the sides of the channel. The channel is positioned on the underside of the deck equidistant from the end milers. The channel is angled at 15° angle relative to the rollers. The open side of the channel and the solid wax faces the inner surface of the belt. The channel extends below the rollers so that the inner surface of the endless belt must come in contact with the channel and wax as it traverses the underside of the deck. The rate of abradement of the Teflon channel controls the amount of wax applied to the belt. Furthermore, as the Teflon slowly abrades solid lubricating Teflon particles are mixed with the wax for enhanced lubrication.

BRIEF DESCRIPTION OF THE DRAWINGS

Corresponding reference characters indicate corresponding structure.

DESCRIPTION OF THE PREFERRED EMBODIMENT

Figure 1:
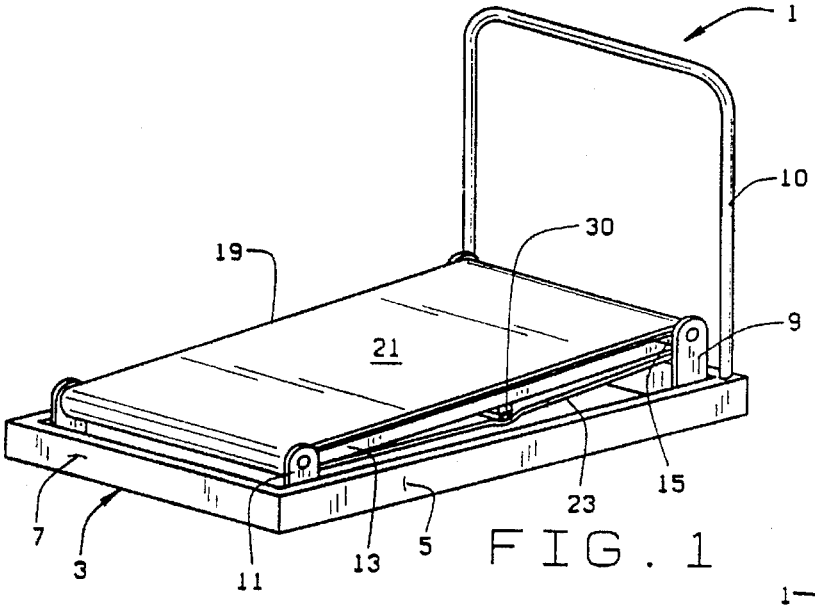
FIG. 1 is an isometric view of a treadmill employing the solid lubrication system of the present invention.
Figure 2:
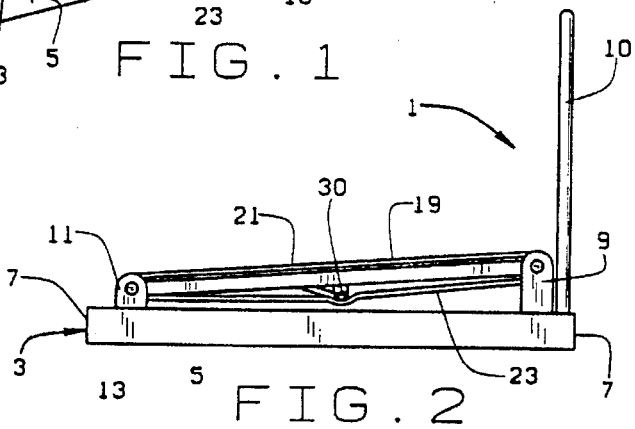
FIG. 2 is side elevational view of the treadmill showing the positioning of the solid lubrication system.

Referring now to the drawings, a treadmill in its most basic form, is indicated in its entirety by reference numeral 1. The treadmill is shown having a lower support frame 3. Support frame 3 has a generally rectangular frame comprising a pair of spaced, elongated side frame members 5 and end frame members 7. A conventional user support handle 10 is attached to the forward ends of the side frame members. There are a pair of opposed forward roller brackets 9 and a pair of opposed rear roller brackets 11 suitably attached to the side frame members 5. A support deck 13 extends between the roller brackets. The support deck 13 can be positioned on an incline, as shown, positioned horizontally, or adjustable from a horizontal to an inclined position. The support deck is comprised of a smooth sheet of metal or the like. A first roller 15 extends transversely between roller brackets 9 and a second idler roller extends transversely between roller brackets 11. It should be noted that the first roller can be an idler roller where the treadmill is manually powered by the user's movement, or a motor driven drive roller, without departing from the scope of the invention. An endless treadmill belt, as generally indicated at 19, is entrained around rollers 15 and 17 and the treadmill belt has a first or upper reach 21 and a second or lower reach 23. Each reach has an inner surface that engages the rollers and the support deck, and an outer or exposed surface.

As stated above, the treadmill described is basic in form. It will be appreciated by those skilled in the art that the actual construction of the treadmill may vary from the treadmill described without departing from the scope of the invention. For the purposes of the claimed invention, it only is necessary that the treadmill have a continuous treadmill belt entrained about rollers and a support deck positioned between an upper reach and lower reach of the treadmill belt.

Figure 3:
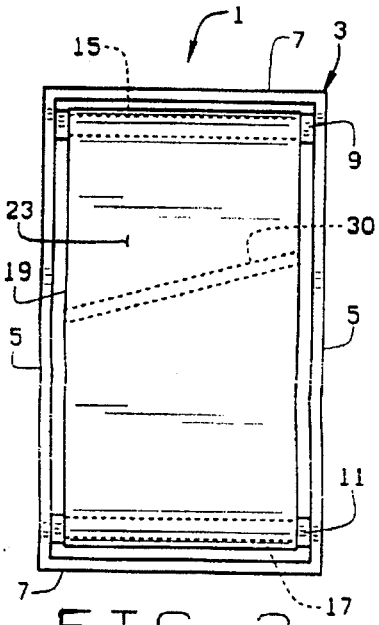
FIG. 3 is a top plan view of the treadmill.
Figure 4:
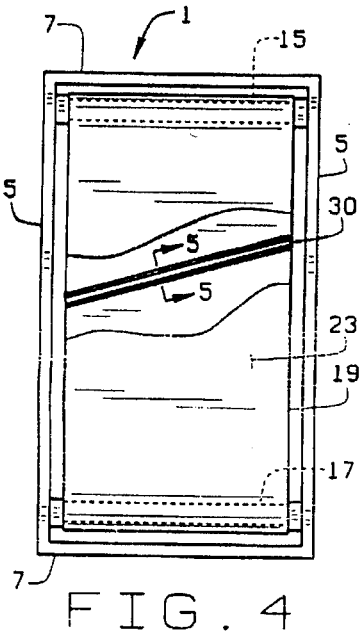
FIG. 4 is a partially cut-away top plan of the treadmill illustrating the orientation of the solid wax delivery system.
Figure 5:
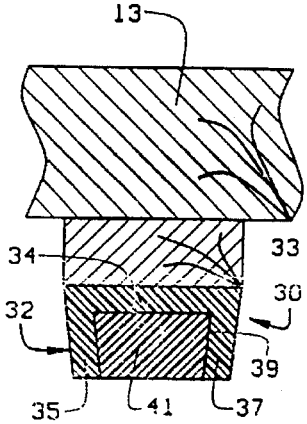
FIG. 5 is a cross-section of the solid wax delivery system of the present invention take along line 5—5 of FIG. 4.

The solid lubricant delivery system of the present invention is indicated generally in the drawings by reference numeral 30. System 30 is comprised of an elongated channel 32. Channel 32 is attached to the underside of deck 13 at a midpoint between the rollers. As shown in FIGS. 3 and 4, the channel is positioned at an angle relative to the rollers. In the preferred embodiment, the angle is 15°. The angled positioning assures that the belt will glide over the channel with less resistance. As best seen in FIG. 5, the channel is attached to an optional spacer bar 33. The spacer bar is employed so that the channel extends downwardly past the vertical plane of the rollers. In the preferred embodiment, the channel extends approximately one inch below the bottom plane of the rollers.

Also as shown in FIG. 5, channel 32 has a upper wall 34 and opposed, slightly inwardly opposed walls 35 and 37. It will be noted that channel 32 is formed from a solid material having lubricant properties, such as Teflon. The respective walls define an space 39 which is filled with a solid wax 41. As shown, channel 32 is in contact with the inner surface of the belt.

In operation, treadmill belt 19 moves in an endless path about the rollers and across the support deck 13. A user is position on the deck exerting a downward pressure on upper reach 21 which, in turn, causes the lower reach 23 to draw up against channel 32. As the inner surface of the lower reach comes in contact with the channel, the wax 41 and the channel material, i.e. Teflon, abrade. The wax adheres to the inner surface of the belt and comes in contact with the surface of deck 13. Because of the heat generated from the friction of the belt against deck 13, the wax picked up on the inner surface of the belt liquefies. The liquid state of the wax causes some hydroplaning of the upper reach of the belt over the deck thereby lowering the coefficient of friction.

If the wax was not contained in channel 32, it soon would dissipate. By combining the wax 41 with the Teflon channel, the rate of wear of the wax is controlled by the rate of wear of the channel. As the walls 35 and 37 wear down, more wax is exposed. Teflon, for example, has high temperature resistance, low coefficient of friction, and is not particularly abrasive. The channel, particularly walls 35 and 37, abrade into small particles that mix with the wax to enhance the lubricating properties of the wax.

The positioning of the channel 32 under the deck is important. The upper reach 21 of the belt, the section on which the user stands, is pushed by the drive roller 15. The lower reach 23 is pulled by the drive roller. By placing the channel on the underside of deck 13 where it engages the lower reach 23 or the "take-up" side of the belt, increased loads on the upper reach 21 increase the belt tension on the pulled side or lower reach 23. Increased tension applies more pressure from the belt to channel 32 thus increasing the rate of wear on channel 32, releasing more wax and Teflon lubricant. Thus, the lubricating system 30 is self-regulating; the more pressure applied to the upper reach 21, the more lubricant is applied to belt. The lubricating system of the present invention has no complex moving parts and can be easily replaced when the channel and wax dissipate.

It will be apparent to those skilled in the art that various changes and modifications can be made in the lubricating system of the present invention without departing from the scope of the appended claims. Therefore, the foregoing description and accompanying drawings should be view as illustrative only and should not be construed in a limiting sense.

I claim:

1. In a treadmill having a stationary deck and a pair of rollers at approximately each end of the deck, one of said rollers being a drive roller, and the other comprising an idler roller, and an endless belt entrained around the drive and idler rollers, a solid lubricant lubrication system for the endless belt entrained around the drive and the idler roller as spaced apart from one another with said belt having an upper reach and a lower reach extending between the rollers, the belt having an inner surface and an outer surface, said stationary deck between the reaches and disposed to support a user positioned on the outer surface of the upper reach, the upper reach being in a sliding relationship with an upper surface of the deck, the solid lubrication comprising a channel formed from a solid lubricating material, the channel having a quantity of solid wax therein, the channel being affixed to a lower surface of the deck and disposed so that the channel and the solid wax are in frictional contact with the inner surface f the lower reach as the belt traverses a continuous path.

2. The lubrication system as set forth in claim 1 wherein the channel is attached to the deck at an angle relative to the transverse axes of the rollers.

3. The solid lubricant lubrication system as set forth in claim 1 wherein the channel is attached at a 15° angle.

4. The solid lubricant lubrication system as set forth in claim 1 wherein an increased tension on the upper reach creates an increased tension of the lower reach against the channel thereby increasing wear on the channel to release more solid lubricant on the inner surface of the lower reach.

5. A treadmill comprising:

a stationary deck;

at least one roller at one end of the deck;

an endless belt entrained on the roller and encircling the deck, the endless belt having a first reach extending across an upper surface of the deck and a second reach extending under the bottom surface of the deck;

a solid lubricant lubrication device affixed to the bottom surface of the deck and positioned to frictionally engage an inner surface of the belt; and wherein said solid lubricant lubrication device further comprises a channel formed of a solid lubricant material, the channel defining a groove having a solid wax lubricant therein.

6. The treadmill of claim 5 further wherein tension placed on the first reach of the endless belt increases the friction of the solid lubrication device against the inner surface of the belt.

7. The treadmill of claim 5 wherein the solid wax lubricant liquefies under heat of friction from the endless belt passing over the deck surface.

8. In treadmill having a stationary deck, at least one roller at one end of the deck, an endless belt entrained on the roller and encircling the deck, the endless belt having a first reach extending across an upper surface of the deck and a second reach extending under a bottom surface of the deck, the improvement comprising:

a lubricating channel on the bottom surface of the deck, the channel positioned at an angle relative to a transverse axis of the roller, the channel being comprised of an abradeable solid lubricant and defining a trough having a solid wax material therein, the channel and wax being in contact with the endless belt whereby movement of the belt caused the wax and the channel to abrade onto the belt to lubricate the belt.

* * * * *